US006655956B2

(12) United States Patent
Zinsen et al.

(10) Patent No.: US 6,655,956 B2
(45) Date of Patent: Dec. 2, 2003

(54) METAL FRAME FOR METAL COILS TO BE HEAT-TREATED

(75) Inventors: Peter Zinsen, Stolberg (DE); Alfons Werner, Aachen (DE)

(73) Assignee: Prym Vermögensverwaltungs-GmbH, Stolberg (DE)

( * ) Notice: Subject to any disclaimer, the term of this patent is extended or adjusted under 35 U.S.C. 154(b) by 0 days.

(21) Appl. No.: 10/181,660

(22) PCT Filed: Jan. 26, 2001

(86) PCT No.: PCT/EP01/00873

§ 371 (c)(1),
(2), (4) Date: Jul. 19, 2002

(87) PCT Pub. No.: WO01/57282

PCT Pub. Date: Aug. 9, 2001

(65) Prior Publication Data

US 2003/0027097 A1 Feb. 6, 2003

(30) Foreign Application Priority Data

Feb. 2, 2000 (DE) ..... 100 04 479

(51) Int. Cl.[7] ..... F27B 11/00
(52) U.S. Cl. ..... 432/206; 432/254.1; 266/263
(58) Field of Search ..... 432/206, 227, 432/254.1, 254.2, 253; 266/252, 264, 262, 263

(56) References Cited

U.S. PATENT DOCUMENTS

| | | | | | |
|---|---|---|---|---|---|
| 2,988,349 | A | * | 6/1961 | Blackman et al. | 432/260 |
| 3,025,045 | A | | 3/1962 | Ornitz | |
| 3,443,800 | A | | 5/1969 | Kennedy | |
| 3,580,331 | A | * | 5/1971 | Wargo | 165/48.1 |
| 4,165,868 | A | * | 8/1979 | Southern | 266/264 |
| 6,063,331 | A | * | 5/2000 | Iszczukiewicz | 266/264 |

FOREIGN PATENT DOCUMENTS

| | | |
|---|---|---|
| DE | 1193526 | 9/1963 |
| DE | 2742844 | 3/1979 |
| FR | 2116691 | 12/1970 |

* cited by examiner

*Primary Examiner*—Gregory Wilson
(74) *Attorney, Agent, or Firm*—Friedrich Kueffner

(57) ABSTRACT

A support frame for metal coils, which are stacked on top of each other for a heat treatment by means of a hot, gaseous medium, especially in bell-type annealing furnaces, has devices on the support frame for guiding the flow of the medium through the coils. The support frame is a framework constructed of I-sections. The end surfaces of the coils are supported on the flanges of the framework I-sections. The webs of the framework I-sections are provided with holes, which serve for guiding the flow of medium.

27 Claims, 6 Drawing Sheets

FIG. 1
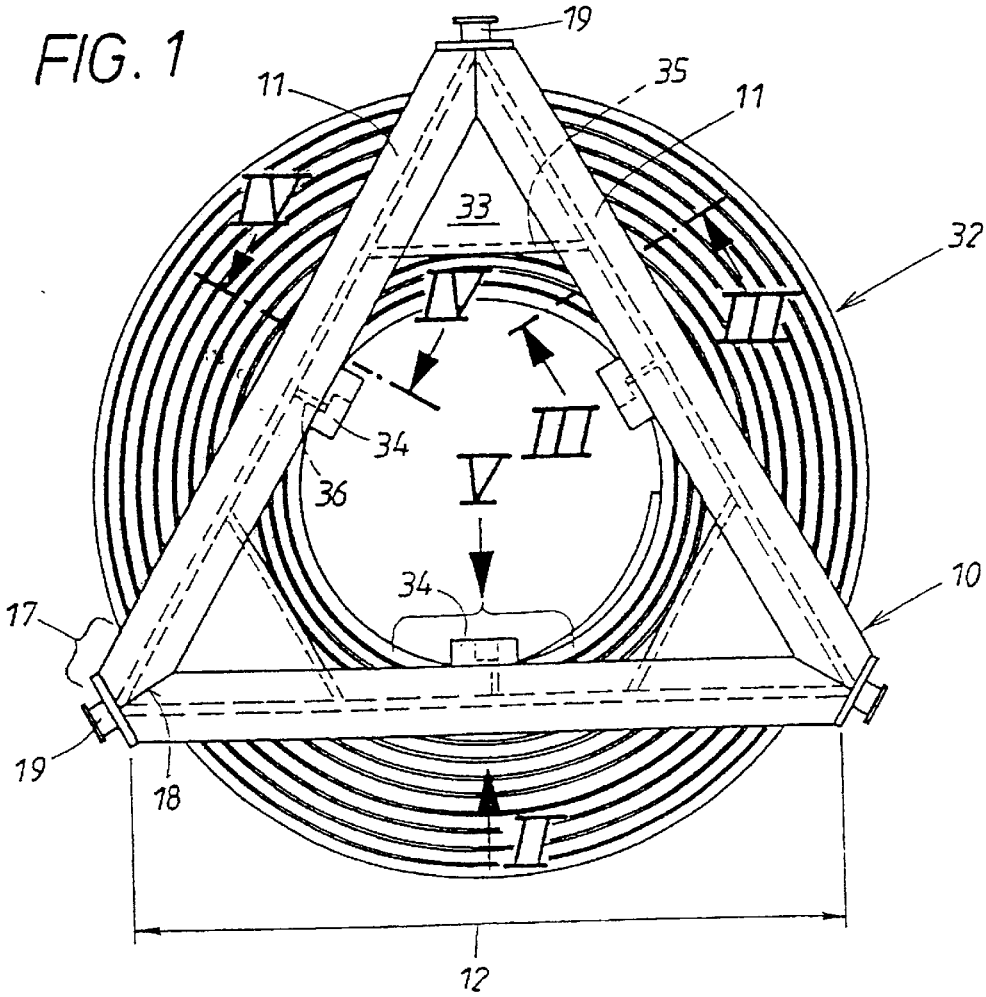
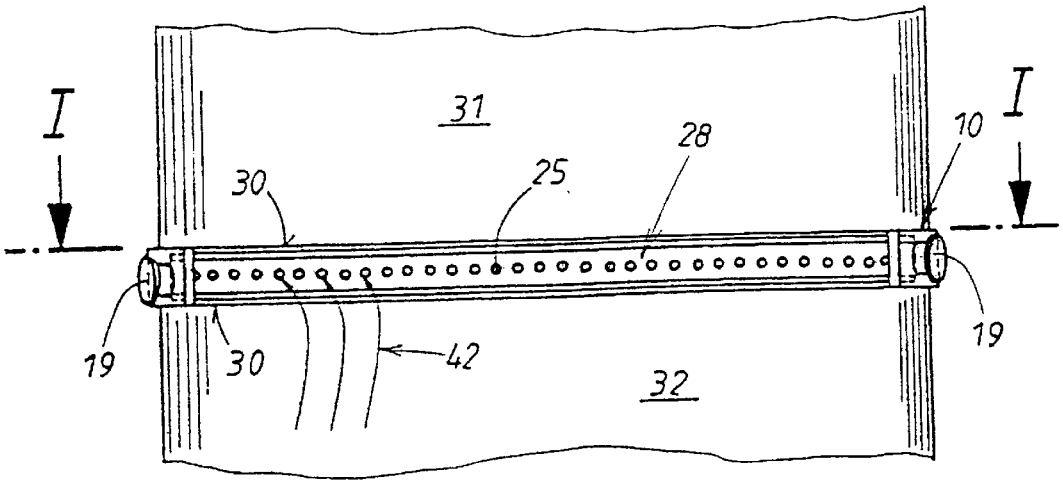
FIG. 2

METAL FRAME FOR METAL COILS TO BE HEAT-TREATED

BACKGROUND OF THE INVENTION

1. Field of the Invention

The invention pertains to a support frame used to stack metal coils or rings on top of each other when they are to be subjected to a heat treatment by a hot, gaseous medium. The strip material of these coils must be annealed after its has been rolled or drawn in order to obtain the desired crystalline microstructure. For this purpose, the coils are stacked on top of each other in so-called bell-type annealing furnaces, for example, with the help of these support frames. The coils are annealed by a gas passing through the furnace or by hot air until the desired microstructure has been achieved. The support frames are intended to ensure the stacked coils are heated as uniformly as possible.

2. Description of the Related Art

The known support frames are complicated in their design. Aerodynamically shaped vane elements, which fan out from the center of the support frame, are used to guide the flowing medium through the coils. The hot medium is set into rotational motion by the vane elements. These support frames are expensive to produce. In addition, the known frames are relatively fragile and do not long withstand the harsh operating conditions which prevail in a rolling mill.

The invention is based on the task of developing a support frame of the general type indicated in the introductory clause of claim 1 for promoting the flow of the medium, this frame being both sturdy in design and producible at low cost. This is accomplished according to the invention by the measures listed in the characterizing clause of claim 1, to which the following special meaning belongs:

SUMMARY OF THE INVENTION

The invention is based on the task of developing a support frame of the aforementioned type for promoting the flow of the medium, this frame being both sturdy in design and producible at low cost. This is accomplished according to the invention by the following measures:

- the support frame is a framework constructed of I-sections;
- the end surfaces of the coils are supported on the flanges of the framework I-sections; and
- the webs of the framework I-sections are provided with holes, which serve as means to guide the flow of medium.

BRIEF DESCRIPTION OF THE DRAWINGS

FIG. 1 shows a top view of one of two stacked metal coils at the level of a support frame according to the invention situated between them, namely, in the viewing direction of the cross-sectional line I—I through the stack shown in FIG. 2;

FIG. 2 shows a side view of the stack in the viewing direction of arrow II of FIG. 1;

DESCRIPTION OF PREFERRED EMBODIMENTS

Figure 3A:
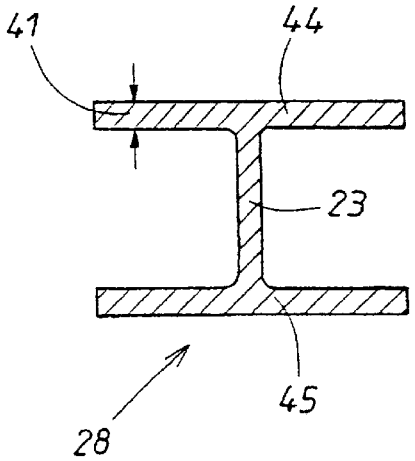
FIGS. 3 and 4 show cross-sectional views through the support frame of FIG. 1 along section lines III—III and IV—IV, respectively, the coil above and the coil below not being included in the diagram.

The support frame consists of a framework 10, which is made up of three crosspieces 11 of equal length 12. Each of the crosspieces 11 consists of an I-shaped section 28 (FIG. 3*a*), or various standard flat sections are welded together to form a framework section 28 with the overall shape of an "I" (FIGS. 3*b*, 3*c*) The framework 10 is located between two stacked coils 31, 32, which are supported by their end surfaces 30 on the framework section 28. The web 23 of the framework section 28 has a row 24 of holes 25, which are arranged essentially down the center line of the web 23. As FIG. 5 illustrates, the distance 26 between adjacent holes 25 is very small, for which reason a very closely spaced row 24 of holes is formed. The distance 26 can be smaller than the diameter 27 of the holes. The crosspieces 11 have a complex structure, which can be seen in FIGS. 3 and 4.

Figure 3B:
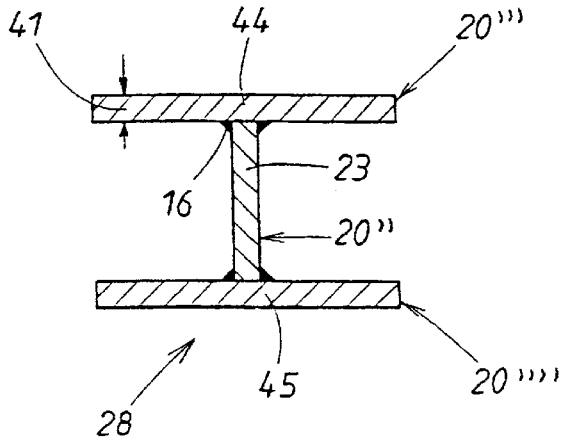
Figure 3C:
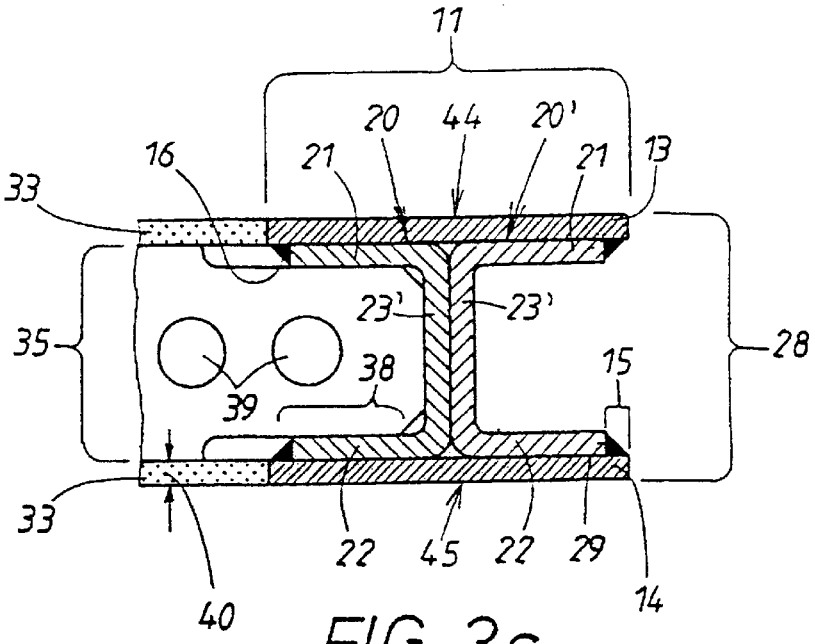
Figure 4A:
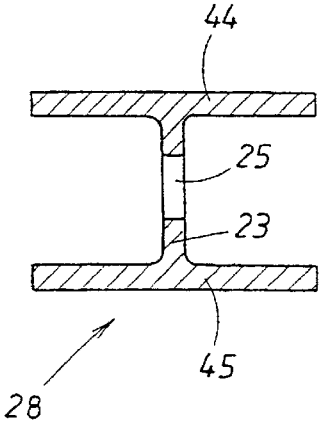
Figure 4B:
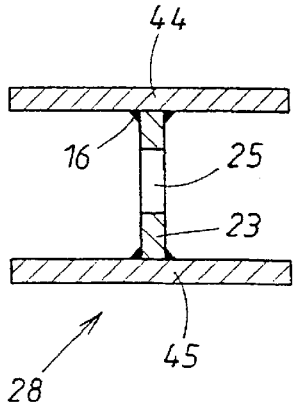
Figure 4C:
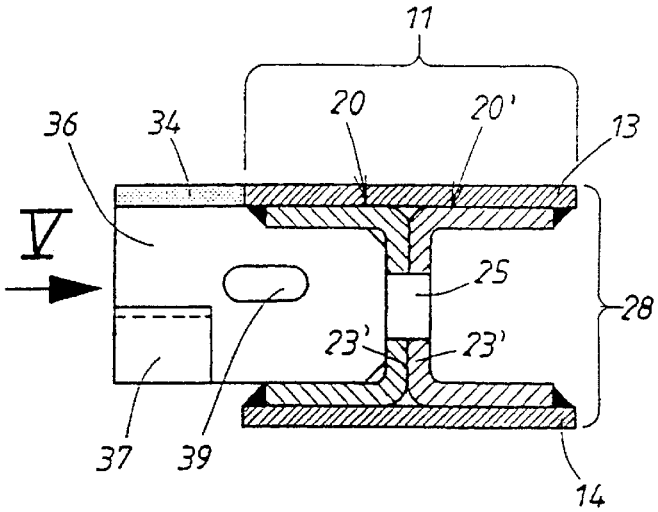
Figure 5:
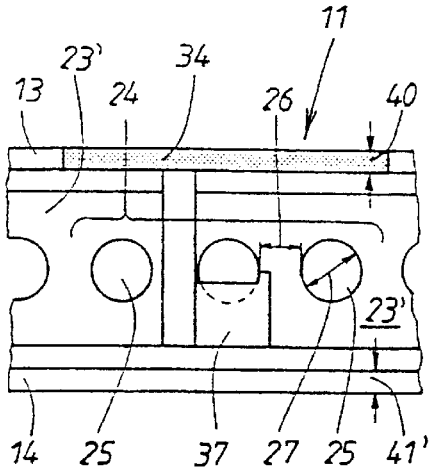
FIG. 5 shows a side view of a component part of the support frame shown in FIG. 1 in the viewing direction of arrow V indicated there.

The I-shaped framework section 28 emphasized in FIGS. 3 and 4 by shading consists of known standard profiles, e.g., such as the I-section shown in FIG. 3*a*.

FIG. 3*b* shows an I-shaped framework section 28 consisting of three flat sections 20", 20'", 20"". The two equally wide flat sections 20'", 20"" form the upper and lower flanges 44, 45 of the framework section 28. The third flat section 20", which is somewhat narrower in this exemplary embodiment, forms the web 23 of the overall framework section 28. The components are joined preferably by welds 16 located on both sides of the end surfaces of the flat section 20".

Another possible embodiment of the framework section 28 is shown in FIG. 3*c*. The framework section 28 consists here of two U-sections 20, 20', arranged as mirror-images of each other, the U-webs 23 of which rest against each other. The webs 23 are provided with continuous series of holes 25, which are aligned with each other. A common flat strip section 13 covers the top of these two component sections 20, 20', and another common flat strip section 14 covers the bottom. These flat strip sections 13, 14 are joined permanently to the U-sidepieces 21, 22; the flat strip sections 13, 14 extend down the length of the framework crosspieces 11. Edge zones 15 of the flat strip sections 13, 14 project beyond the free edges 29. The joints between the flat strip sections 13, 14 and the U-shaped component sections 20, 20' are created by welds 16 between the sidepiece ends 29 and the edge zones 15 of the strips.

As can be seen in FIG. 1, the framework 10 forms the outline of an equilateral triangle. The individual crosspieces 11 are mitred at the corners, as can be seen at 18 in FIG. 1. In the corner areas 17, furthermore, lugs 19 are present, which allow the framework to be attached to a crane. The crane serves to lift the coil 31 seated on the framework 10 and to remove it from the stack. The lugs project beyond the coil 31 supported on the framework 10.

In the angle between two abutting framework crosspieces 11, there is a corner plate 33, which connects the two crosspieces 11 to each other. This is illustrated in FIG. 3*c* by coarse dots. In addition, the framework crosspieces 11 are provided at certain points along their long sides facing the interior of the frame with plate-shaped brackets 34, which, for the sake of clarity, are emphasized in FIGS. 4 and 5 by fine dots. The corner plates 33 and the brackets 34 lie essentially in the same plane as the flanges 44, 45 or of the flat strip sections 13, 14 of the overall I-section 28. In the present case, the brackets 34 are located at the center of the length of the crosspieces 11 and point toward the center of the triangle. The brackets 34 also serve to cover or support the inner turns of the coil 31, 32 in question. Both the corner plates 33 and the brackets 34 are provided with various support elements 35–37.

The support element 35 for the corner plate 33 consists of an essentially vertical bracket plate 35, which, as can be seen in FIG. 3*c*, almost completely fills up the free space in the overall section 28. Thus, the end 38 of the bracket plate 35 fits into the space between the two U-sidepieces 21, 22 of the component section 20 and extends all the way to the U-web 23'. The brackets 34 are also supported from underneath by bracket plates 36. For stiffening, it is also possible to provide a block 37 at this point. The two bracket plates 35, 36 are provided with slit-like or round openings 39, which promote the flow of the medium, as already mentioned above.

As can be seen in FIG. 3*c*, the corner plates 33 can be provided on both the upper and the lower flat strip sections 13, 14. These corner plates 33 and the brackets 34 can be of the same thickness 40, which is essentially the same as the thickness 41 of the two flat strip sections 13, 14 or of the flanges 44, 45 of the framework I-section 28.

Figure 6:
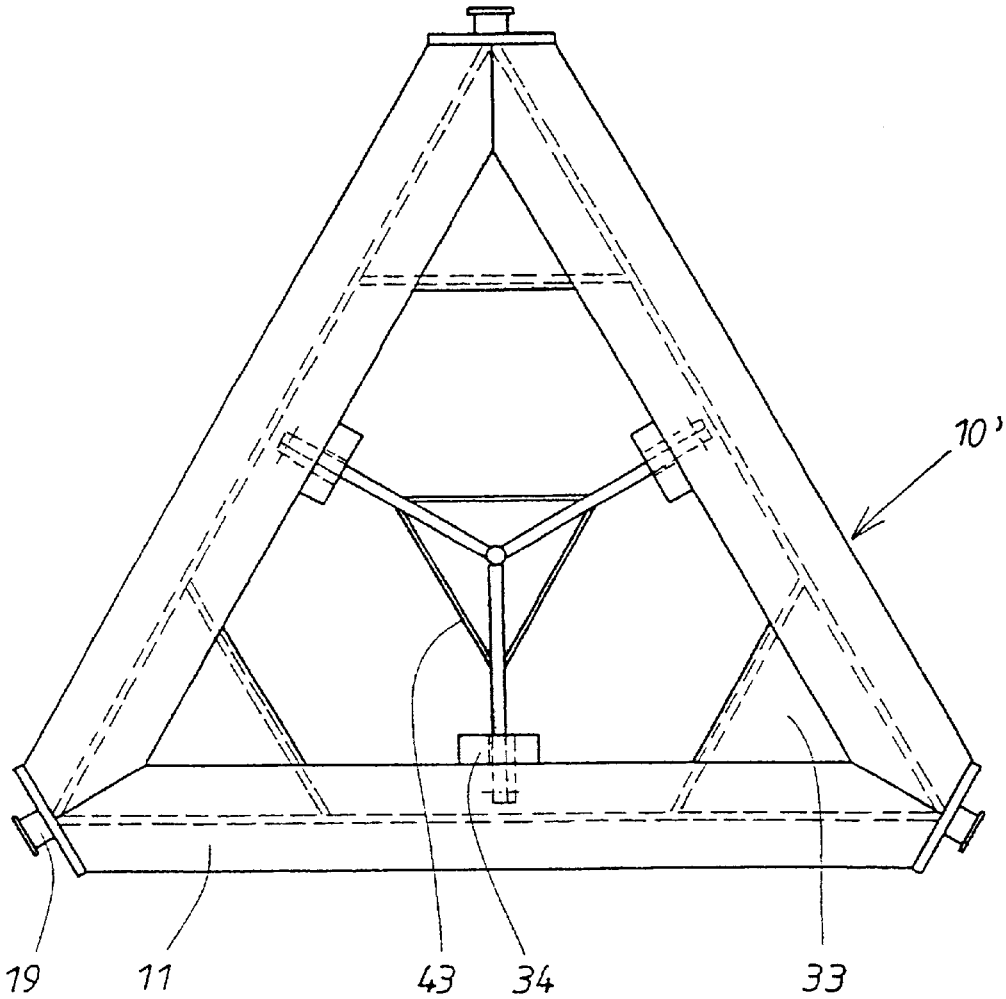
FIG. 6 shows a top view of a support frame according to the invention with a star insert.
Figure 8:
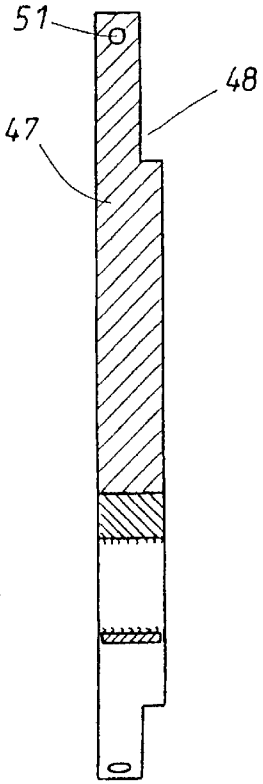
FIG. 8 shows a side view of the start insert of FIG. 7.
Figure 7:
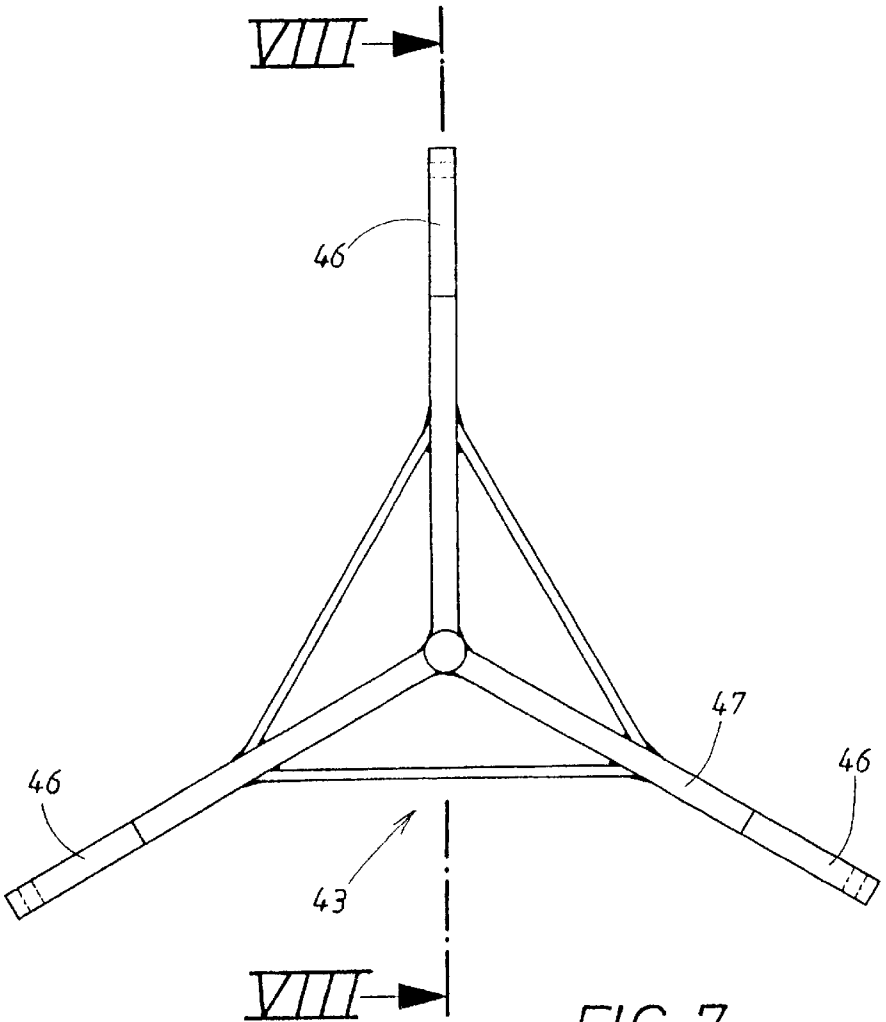
FIG. 7 shows a top view of the star insert of FIG. 6.
Figure 9C:
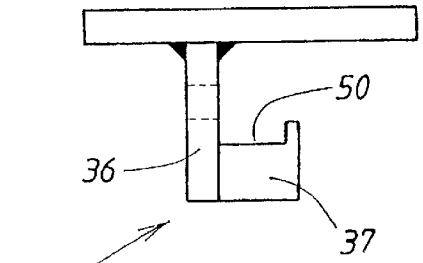
FIG. 9 shows a top view and two side views of the plate-shaped bracket.
Figure 9A:
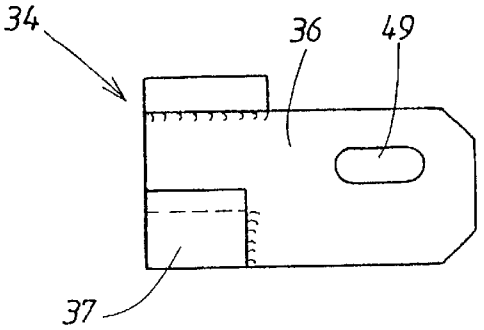
Figure 9B:
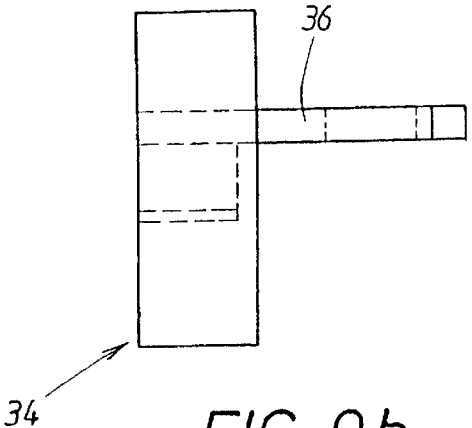

FIG. 6 shows an additional example of a support frame according to the invention with a framework 10'. In the angle between two abutting framework crosspieces 11, there is a corner plate 33, which connects two crosspieces 11 together. In addition, the long sides of the framework crosspieces 11 facing the interior of the framework are provided with plate-shaped brackets 34 at the center point of their length.

In this case, a star insert 43 is provided to give additional support to the coils 31, 32 (not shown in this figure). The branches 47 of the star insert 43 extending from the center of the star terminate at the plate-shaped brackets 34, where they are supported. So that the star insert 43 can be attached to the brackets 34, the thickness of the ends 46 of the star insert branches 47 is reduced by a step-like recess, and a hole 51 is made through the end. The ends 46 fit into a shaped cavity 50 in the bracket 34. This shaped cavity 50 is bounded on the sides by the block 37 and the bracket plate 36. A hole 49 is also provided in the bracket plate 36 of the bracket 34. The ends 46 of the star insert branches 47 are pushed into the shaped cavity 50 until the hole 51 in the star insert branch 47 and the hole 49 in the bracket plate 36 are aligned; suitable connecting means can pass through these holes to fasten the two components together.

The star insert 43 lies essentially on the same plane as the flanges 44, 45 of the framework I-section 28.

LIST OF REFERENCE NUMBERS

10 framework
10' framework
11 crosspiece of 10
12 crosspiece length of 11
13 flat strip section of 11 at 21
14 flat strip section of 11 at 22
15 edge zone of 13, 14
16 weld
17 corner area of 10
18 mitred cut at 17
lug on 17
20, 20' U-section, component part of 28
20", 20'", 20"" flat section, component part of 28
21 first U-sidepiece of 20, 20'
22 second U-sidepiece of 20, 20'
23 web of 28
23' U-web of 20, 20'
24 row of holes (FIG. 5)
25 hole in 23, 23'
26 distance between 25 (FIG. 5)
27 hole diameter of 25
28 framework section, overall section
29 free sidepiece end of 21, 22 (FIG. 3*c*)
30 end surface of 31, 32 (FIG. 2)
31 upper coil (FIG. 2)
32 lower coil (FIGS. 1, 2)
33 corner plate
34 plate-shaped bracket
35 support element for 33, bracket plate
36 support element for 34, bracket plate
37 support element for 34, block
38 plate end of 35 (FIG. 3*c*)
39 opening in 35, 36
40 thickness of plate 33, 34 (FIG. 3*c*, FIG. 5)
41 thickness of flange 44, 45 (FIGS. 3*a*, 3*b*)
42 flow arrow
43 star insert
44 upper flange of 28
45 lower flange of 28
46 end of 43
47 star insert branch
48 recess in 46
49 hole in 36
50 shaped cavity
51 hole in 46

What is claimed is:

1. Support frame for metal coils (31, 31) which are stacked on top of each other for a heat treatment by means of a hot, gaseous medium, especially in bell-type annealing furnaces, with means on the support frame for guiding the flow (42) of the medium through the coils (31, 32), wherein the support frame is a framework (10, 10') constructed of I-sections;

the end surfaces (30) of the coils (31, 32) are supported on the flanges (44, 45) of the framework I-sections (23); and the webs (23) of the framework I-sections (28) are provided with holes (25), which serve as means to guide the flow of medium (42).

2. Support frame according to claim 1, wherein the framework (10, 10') consists of three framework crosspieces (11) and has a triangular outline.

3. Support frame according to claim 2, wherein the triangular framework (10, 10') is formed out of framework crosspieces (11) of equal length (12).

4. Support frame according to claim 1, wherein the holes (25) are arranged in a row (24) extending essentially down the center of the length of the webs (23, 23').

5. Support frame according to claim 1, wherein the distances (26) between the holes (25) are smaller than or equal to the diameters (27) of the holes.

6. Support frame according to claim 1, wherein the I-shaped framework section (28) is constructed out of three flat sections (20", 20'", 20""), where the flat section (20") forms the web (23), and the flat sections (20'", 20"") form the flanges (44, 45) of the framework section (28).

7. Support frame according to claim 6, wherein the joint between the flat section (20") and the flat sections (20'", 20"") consists of welds (16), which are arranged on both sides of the two end surfaces of the flat section (20").

8. Support frame according to claim 1, wherein the framework section (28) is constructed out of two U-sections (20, 20'), arranged as mirror images of each other, where the U-sidepieces (21, 22) of the two component sections (20, 20') face away from each other.

9. Support frame according to claim 8, wherein the U-webs (23') of the two U-sections (20, 20') rest against each other, and in that the holes (25) in the two U-webs (23') are aligned with each other.

10. Support frame according to claim 8, wherein a common flat strip section (13) covers the tops of the two U-sidepieces (21, 22) of the component sections (20, 20'), whereas another common strip section (14) covers the bottoms, the flat strip sections extending along the length of the framework crosspieces (11), and in that the flat strip sections (13, 14) are permanently joined to the two U-sidepieces (21, 22) of the two component sections (20, 20').

11. Support frame according to claim 10, wherein edge zones (15) of the flat strip sections (13, 14) project beyond the free ends (29) of the two sidepieces (21, 22), and in that the flat strip sections (13, 14) are joined to the two U-sidepieces (21, 22) by welds, which are located between the edge zones (15) and the end surfaces of the U-sidepieces (21, 22).

12. Support frame according to claim 1, wherein the framework sections (28) are mitred (18) in the corner area of two abutting framework crosspieces (11).

13. Support frame according to claim 1, wherein the framework has corner areas (17) and wherein lugs (19) for the attachment of a crane or the like are located in the corner areas (17) of the framework (10, 10'), the lugs (19) projecting radially beyond the circumference of the coil (31) supported on the framework (10, 10').

14. Support frame according to claim 1, wherein the framework has crosspieces and wherein, in the angle between two abutting crosspieces (11), a corner plate (33) is provided, which connects the two crosspieces (11) together.

15. Support frame according to claim 14, wherein the framework crosspieces (11) are provided at certain points along the long sides facing the interior of the framework with plate-shaped brackets (34), which support the end surface (30) of the coil (31) resting on the framework (11).

16. Support frame according to claim 15, wherein the plate-shaped brackets (34) and/or the corner plates (33) have a thickness (41, 40) which is essentially the same as that of the flanges (44, 45).

17. Support frame according to claim 15, wherein the plate-shaped brackets (34) and/or the corner plates (33) have a thickness (41', 40) which is essentially the same as that of the flat strip sections (13, 14).

18. Support frame according to claim 15, wherein the brackets (34) are located essentially at the center of the length of the crosspieces (11) of the triangular framework (10, 10').

19. Support frame according to claim 18, wherein the bracket plate (36) has a hole (49) for the attachment of a star insert (43).

20. Support frame according to claim 18, wherein the brackets (34) comprise a block (37), which in combination with the bracket plate (36) forms a shaped cavity (50).

21. Support frame according to claims 18, wherein the brackets (34) are connected to the branches (47) of the star insert (43), where the star insert (43) lies essentially on the same plane as the flanges (44, 45) of the framework sections (28).

22. Support frame according to claim 21, wherein the thickness of the ends (46) of the star insert branches (47) is reduced by a step-like recess (48), and in that the end (46) is provided with a hole (51).

23. Support frame according to claim 22, wherein the ends (46) fit into the shaped cavity (50) of the bracket (34) and in that the hole (49) in the bracket (34) is aligned with the hole (51) in the star insert branch (47) so that the two can be connected.

24. Support frame according to claim 15, wherein the plate-shaped bracket (34) and/or the corner plate (33) are provided with support elements (35–37), which fit into the interior of the framework sections (28).

25. Support frame according to claim 24, wherein the support elements consist of bracket plates (35, 36), extending essentially in the vertical direction, which fit between the flanges (44, 45) and extend essentially all the way to the web (23).

26. Support frame according to claim 25, wherein the bracket plates (35, 36) have openings (39) for the flow of medium.

27. Support frame according to claim 14, wherein the corner plate (33) and/or the bracket (34) lie essentially on the same plane as the flanges (44, 45) of the framework sections (28).

* * * * *